US007414542B2

(12) United States Patent
McMahon

(10) Patent No.: US 7,414,542 B2
(45) Date of Patent: Aug. 19, 2008

(54) SYSTEM AND METHOD FOR SIGNALING STATUS OF TRAFFIC FLOW

(75) Inventor: Timothy H. McMahon, Boynton Beach, FL (US)

(73) Assignee: Electronic Data Systems Corporation, Plano, TX (US)

( * ) Notice: Subject to any disclaimer, the term of this patent is extended or adjusted under 35 U.S.C. 154(b) by 95 days.

(21) Appl. No.: 11/002,177

(22) Filed: Dec. 2, 2004

(65) Prior Publication Data

US 2006/0125655 A1 Jun. 15, 2006

(51) Int. Cl.
*G08G 1/095* (2006.01)

(52) U.S. Cl. ..... 340/907; 340/995.1; 701/209

(58) Field of Classification Search ..... 340/905, 340/906, 907, 209, 995.1, 995.11, 995.13, 340/995.17, 995.19, 95.21; 701/209, 210, 701/211

See application file for complete search history.

(56) References Cited

U.S. PATENT DOCUMENTS

| | | | | | |
|---|---|---|---|---|---|
| 4,135,144 | A | | 1/1979 | Elmasian | 340/32 |
| 4,223,295 | A | | 9/1980 | Bonner et al. | 340/32 |
| 4,241,326 | A | | 12/1980 | Odom | 340/33 |
| 4,775,865 | A | | 10/1988 | Smith et al. | 340/906 |
| 5,083,125 | A | | 1/1992 | Brown et al. | 340/906 |
| 5,345,232 | A | | 9/1994 | Robertson | 340/906 |
| 5,444,442 | A | | 8/1995 | Sadakata et al. | 340/916 |
| 5,905,434 | A | * | 5/1999 | Steffan et al. | 340/464 |
| 5,911,773 | A | * | 6/1999 | Mutsuga et al. | 701/200 |
| 5,955,968 | A | | 9/1999 | Bentrott et al. | 340/906 |
| 6,072,406 | A | | 6/2000 | Leonard et al. | 340/902 |
| 6,154,126 | A | * | 11/2000 | Beasley et al. | 340/468 |
| 6,553,285 | B1 | * | 4/2003 | Bahmad | 701/1 |
| 6,577,946 | B2 | | 6/2003 | Myr | 701/117 |
| 6,731,202 | B1 | * | 5/2004 | Klaus | 340/425.5 |

(Continued)

FOREIGN PATENT DOCUMENTS

DE 102 03 242 7/2003

(Continued)

OTHER PUBLICATIONS

Notification of Transmittal of the International Search Report and the Written Opinion of the International Searching Authority, or the Declaration (2 pages), International Search Report (4 pages) and Written Opinion of the International Searching Authority (6 pages) re International Application No. PCT/US2005/037996 mailed Mar. 6, 2006.

(Continued)

*Primary Examiner*—Davetta W. Goins
*Assistant Examiner*—Edny Labbees
(74) *Attorney, Agent, or Firm*—Fish & Richardson, P.C.

(57) ABSTRACT

In one general aspect, a method for signaling traffic flow information includes monitoring a status for a traffic restrictor, generating a wireless signal indicative of the status of the traffic restrictor, and communicating the wireless signal to a receiver. In another general aspect, a wireless receiver includes a wireless interface and a processor. The wireless interface receives a wireless signal indicative of a status of a traffic restrictor. The processor determines a portion of a route for a vehicle based upon the status of the traffic restrictor.

27 Claims, 3 Drawing Sheets

U.S. PATENT DOCUMENTS

| | | | | |
|---|---|---|---|---|
| 6,747,574 | B2 * | 6/2004 | Butzer et al. | 340/907 |
| 6,940,422 | B1 * | 9/2005 | Bachelder et al. | 340/906 |
| 6,985,090 | B2 * | 1/2006 | Ebner et al. | 340/907 |
| 7,095,318 | B1 * | 8/2006 | Bekhor | 340/485 |
| 7,142,104 | B1 * | 11/2006 | Blueford | 340/472 |
| 7,289,019 | B1 * | 10/2007 | Kertes | 340/435 |
| 2003/0142044 | A1 * | 7/2003 | Berry | 345/55 |
| 2004/0051651 | A1 | 3/2004 | Carter | |
| 2004/0239493 | A1 * | 12/2004 | Miller | 340/471 |
| 2005/0094407 | A1 * | 5/2005 | Heald et al. | 362/362 |
| 2005/0200467 | A1 * | 9/2005 | Au et al. | 340/465 |

FOREIGN PATENT DOCUMENTS

| | | |
|---|---|---|
| DE | 102 03 891 | 8/2003 |
| EP | 1 321 742 | 6/2003 |
| WO | WO 02/279690 | 4/2002 |

OTHER PUBLICATIONS

Notification Concerning Transmittal of International Preliminary Report on Patentability, International Preliminary Report on Patentability, and Written Opinion of the International Searching Authority, PCT/US2005/037996, mailed Jun. 14, 2007, 8 pages.

* cited by examiner

SYSTEM AND METHOD FOR SIGNALING STATUS OF TRAFFIC FLOW

TECHNICAL FIELD

This disclosure relates generally to traffic flow management, and more particularly to a system and method for signaling status of traffic flow.

BACKGROUND

Vehicle traffic flow may be controlled or impeded by a variety of conditions. For example, traffic lights control the ability of vehicles to move through an intersection. In some cases, how a particular condition affects the traffic flow may depend on a status for the traffic condition. Thus, for example, if a traffic light is red for one direction, traffic flow in that direction is impeded in that direction for a certain period of time. Drivers often become aware of the status of a particular traffic flow device only after viewing the device, which limits the ability of drivers to be aware of traffic conditions and to adjust their routes accordingly. Particularly in the case of emergency vehicles, this can substantially interfere with the ability of vehicles to reach a destination in a timely manner. Also, in conditions of limited visibility, such as rainstorms or fog, these problems can become even more pronounced.

SUMMARY

This disclosure relates to a system and method for signaling status of traffic flow. Various implementations of such a system or method may help to reduce or eliminate drawbacks associated with drivers being unaware of the status of traffic flow at a particular location. In one general aspect, a method for signaling traffic flow information includes monitoring a status for a traffic restrictor, generating a wireless signal indicative of the status of the traffic restrictor, and communicating the wireless signal to a receiver. In another general aspect, a wireless receiver includes a wireless interface and a processor. The wireless interface receives a wireless signal indicative of a status of a traffic restrictor. The processor determines a portion of a route for a vehicle based upon the status of the traffic restrictor.

Certain implementations may include one or more of the following features. Wireless signals may be encrypted. A central station may relay wireless signals from a signaling station to a vehicle. Traffic restrictors may include a traffic light (having a color associated with a particular direction), a weather condition, or a road hazard. Wireless receivers may be located within a vehicle. Positioning systems, such as global positioning system (GPS) locators, may be used to determine positions for traffic restrictors and/or vehicles, and may further be used to determine a vehicle's heading and speed. Methods for determining a route may include steps such as determining that a particular route requires a change in the status of a traffic restrictor and communicating a wireless request for the status change. Methods for signaling traffic flow information may further include receiving a request to change the status of the traffic restrictor and changing the status of the traffic restrictor in response to the request.

DETAILED DESCRIPTION

Figure 1:
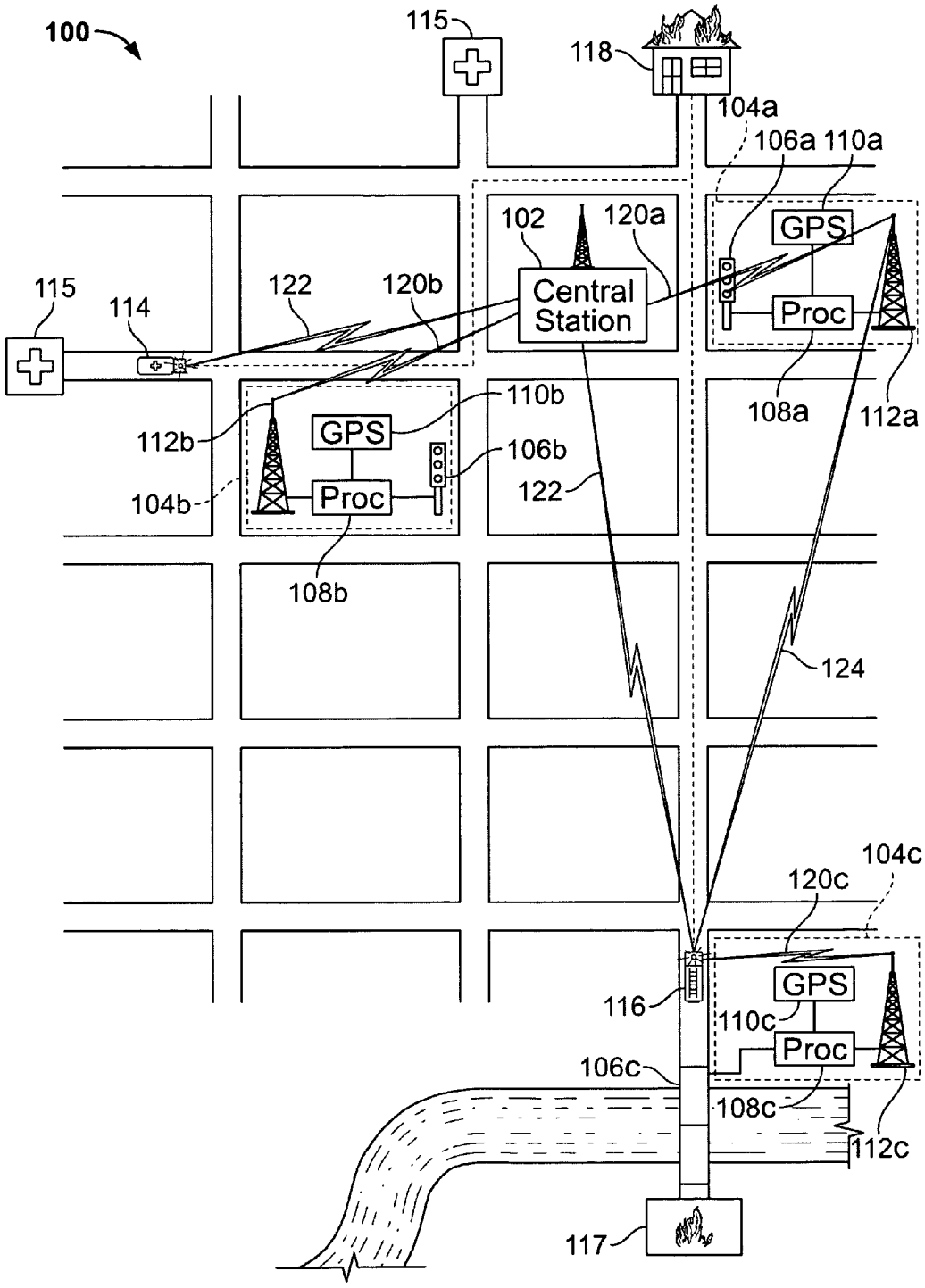
FIG. 1 depicts a traffic signaling system that communicates status information for traffic control devices to vehicles.

FIG. 1 illustrates an example implementation of a traffic signaling system 100. The depicted traffic signaling system 100 includes a central station 102 and various signaling stations 104 (e.g., stations 104*a*, 104*b*, and 104*c*). Overall, the system 100 signals the status of traffic flow to emergency vehicles, such as an ambulance 114 and a fire truck 116. The traffic status information may then be used to allow the emergency vehicles 114 and 116 to reach the location of an emergency (illustrated as a destination 118) expeditiously.

The central station 102 serves as a coordination point for receiving and broadcasting traffic status information from the signaling stations 104. The central station 102 may also receive communications (such as commands) from vehicles and relay those communications to the signaling stations 104. The central station 102 and the signaling stations 104 communicate with one another and with the emergency vehicles 114 and 116 using any suitable form of wireless communication. Such forms of communication may include radio frequency signals, infrared signals, satellite communication, or any other medium for wireless communication, and they may use any suitable protocol for wireless communication, including such techniques as code-division multiplexing, time-division multiplexing, or numerous other protocols. In particular implementations, wireless signals may be encrypted to restrict access to the system 100, so that only certain vehicles may receive signals from the system 100 and/or transmit messages to the system 100. Also, certain wireless communication connections, such as the connections between the central station 102 and the signaling stations 104, may be replaced with physical connections, such as wireline or optical connections.

The signaling stations 104 are each associated with a traffic control device 106. In the depicted implementation, the traffic control devices 106 include two traffic lights 106*a* and 106*b* and a drawbridge 106*c*. Each signaling station 104 also includes a processor 108, a global positioning system (GPS) locator 110, and a wireless interface 112 illustrated as an antenna. The processor 108 may include any hardware and/or software for processing information, including a microprocessor, microcontroller, application-specific integrated circuit (ASIC), digital signal processor (DSP), or numerous other information-processing components. Although the processors 108 are illustrated as single processors, it should be understood that multiple local and/or remote processors working together are contemplated as well. The GPS locator 110 may include any suitable device for determining the coordinates of the location where the respective signaling station 104 is placed based on signals provided by the network of GPS satellites. The use of a GPS locator 110 is only one example of a technique for specifying the location of the signaling stations 104, but it should be understood that other techniques for determining the location of the signaling stations may be employed as well. For example, the signaling stations 104 or the central station 102.could maintain preprogrammed location information.

Signaling stations 104 may be used in a centralized system 100 having a central station 102 that coordinates traffic flow signaling and management, or they may additionally or alternatively communicate directly with emergency vehicles 114 and/or 116. As shown in FIG. 1, the signaling stations 104*a* and 104*b* communicate wireless signals 120*a* and 120*b* to the central station 102, which then relays the information from the signaling stations in the form of wireless signals 122 to the emergency vehicles 114 and 116. On the other hand, the signaling station 104*c* associated with the drawbridge 106*c* communicates its wireless signal 120*c* directly to the fire truck 116. Similarly, the fire truck 116 is illustrated sending a command 124 to one of the signaling stations 104. Consequently, the described functions of the traffic signaling system 100 may be distributed in a decentralized manner or consolidated within one or more central stations 102, and any descriptions of particular implementations may be modified to accommodate those variations.

The traffic flow information may include any manner of useful information related to the control of traffic by the traffic flow devices 106. For example, the signaling station 104*c* may communicate information about the location of the drawbridge 106*c* and whether the drawbridge 106*c* is open or closed. The signaling stations 104*a* and 104*b* associated with the traffic lights 106*a* and 106*b* may communicate information such as the respective locations of the traffic lights 106*a* and 106*b*, the current signal status in a particular direction (red, yellow, green, turn light), the time until the next status change, the status after the next status change, or other similar information. This information may be used by the emergency vehicles 114 and 116 to make determinations about options for routes, about availability to respond to emergencies, about estimated time of arrival at the location of an emergency, and about whether to control traffic flow devices 106 to change status to facilitate the ability of the emergency vehicles 114 and 116 to reach the destination 118.

In one example of the operation of the traffic signaling system 100, an emergency response is triggered by a notification that there is an emergency at destination 118. In response to the notification, the ambulance 114 is dispatched from a hospital 114, and the fire truck 116 is dispatched from a fire station 117. The ambulance 114 and the fire truck 116 receive the wireless signals 122 from the central station 102 and from the signaling station 104*c* that indicate the status of traffic control devices 106. Based on the traffic flow information thus received, the emergency vehicles 114 and 116 may determine availability to respond to an emergency and to select a suitable route to the destination 118. Furthermore, commands may be sent to the traffic flow control devices 106 to control their respective status. Thus, for example, if the fire truck 116 determines that the status of the traffic light 106*a* will interfere with the fire truck 116 reaching the destination 118 by slowing or stopping the fire truck's progress, then the fire truck 116 may send a command 124 to the signaling station 104*a* instructing the signaling station 104*a* to change the status of the traffic light 104*a*. In other implementations, such requests may be managed and coordinated by the central station 102. Similarly, the ambulance 114 may detect the status change in the traffic light 106*a* and may take a route that has a traffic flow that is not impeded by the traffic light 106*a*, so as not to delay the progress of the fire truck 116 to the destination 118. The traffic signaling system 100 may also be used to determine the availability of the emergency vehicles 114 and 116. For example, if the drawbridge 106*c* had been open and the fire truck 116 was unable to response to the emergency in a timely manner, the information would allow a different emergency vehicle to be summoned from another location to address the emergency. The information provided by the traffic signaling system 100 may also be used on the return path, so that if, for example, traffic flow to the hospital 115 is impeded, the ambulance 114 may travel to a different hospital 115.

Although a particular implementation of the traffic signaling system 100 in an emergency response system has been described, it should be understood that the described techniques are readily adaptable to use with all other types of vehicles. For example, non-emergency vehicles may use status information from the traffic signaling system 100 to select more desirable routes based on the status of traffic control devices 106. Also, the status information for impediments to traffic flow need not be limited to traffic control devices 106. The traffic signaling system 100 may also provide information such as weather conditions (examples of which include fog on the roadway or flooded roadways), road hazards (such as wrecks), or other condition potentially adverse to traffic. In general, the traffic signaling system may be adapted to use with any traffic restrictor, where "traffic restrictor" refers to any localized device or condition that may impede traffic depending on a status of the device or condition.

Figure 2:
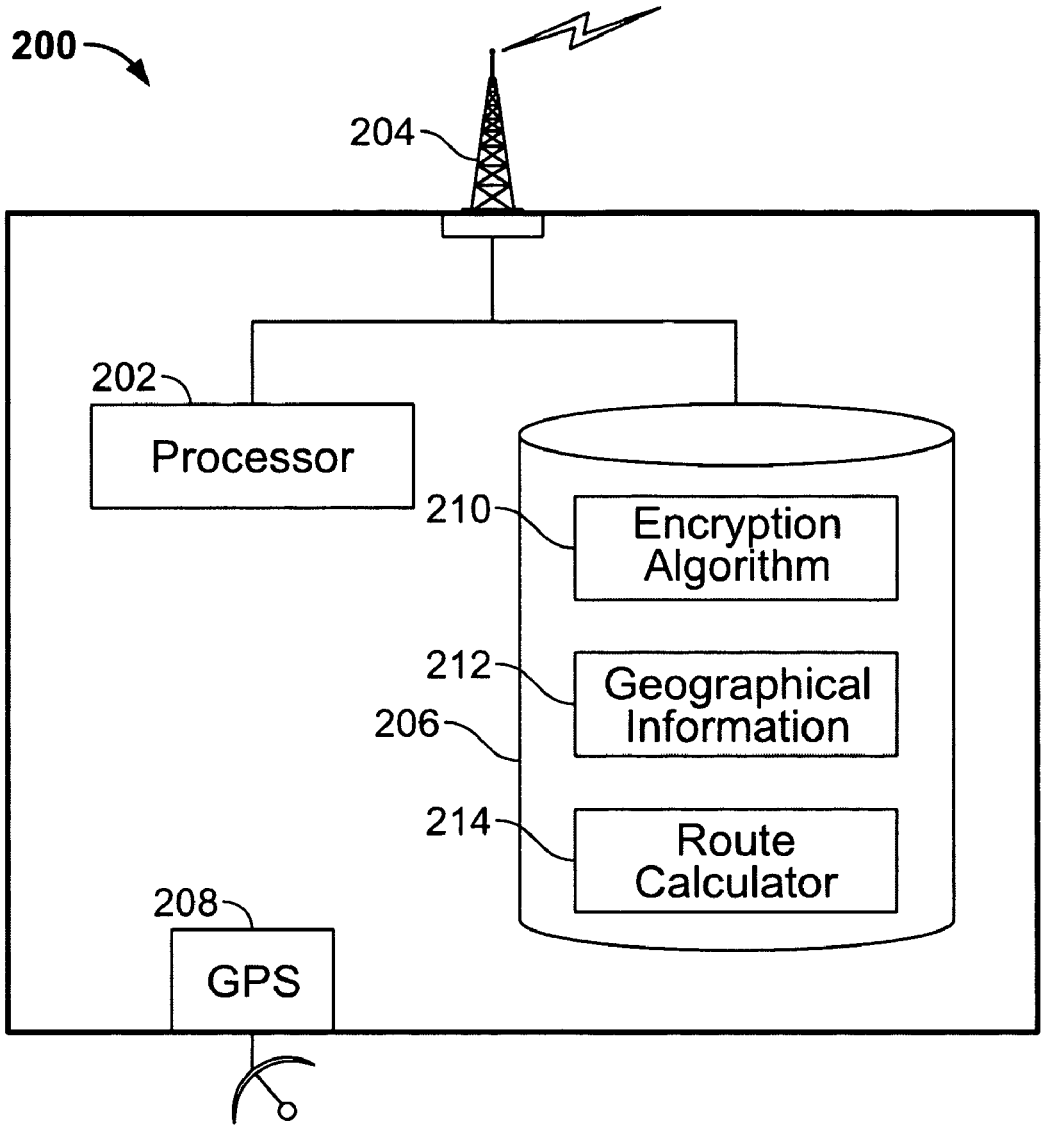
FIG. 2 depicts a wireless receiver used in a vehicle to receive traffic flow information from a traffic signaling system.

FIG. 2 illustrates an example of a wireless receiver 200 that receives information from the traffic signaling system 100 and determines a route based on that information. In the depicted embodiment, receiver 200 includes a processor 202, a wireless interface 204, a memory 206, and a positioning system 208. The memory 206 stores an encryption algorithm 210, geographical information 212, and an algorithm 214 for calculating routes ("route calculator 214") based on information received from the traffic signaling system 100.

The processor 202 may include any hardware and/or software for processing information, including a microprocessor, microcontroller, application-specific integrated circuit (ASIC), digital signal processor (DSP), or numerous other information-processing components. Although depicted as a single processor 202, the functions performed by the processor 202 may also be distributed among several components. The wireless interface 204 allows the wireless receiver 200 to receive information from the traffic signaling system 100 in any form and using any protocol appropriate to the traffic signaling system 100. The wireless interface 204 may also allow the wireless receiver 200 to transmit signals to the traffic signaling system 100. The memory 206 may be any form of information storage accessible by the processor 202, which may be local, remote, and/or removable. The memory 206 may include a suitable information storage medium, such as magnetic media or optical media, and it may be volatile or non-volatile. The positioning system 208 may be any suitable device for tracking the position of the wireless receiver 200, including but not limited to a GPS locator. The positioning system 208 may also measure characteristics for a vehicle carrying the wireless receiver 200, such as the vehicle's heading and speed, either by direct measurement (e.g., compass readings, speedometer values) or by calculation from position information.

The information stored in memory 206 is used by the processor 202 to perform a variety of functions. The encryption algorithm 210 encrypts and/or decrypts messages exchanged with the traffic signaling system 100. Any encryption algorithm suitable for use with the protocol of the traffic signaling system 100, with a public or private key, may be used, and the encryption algorithm 210 may also include authentication or other security measures to allow the wireless receiver 200 to obtain access to the traffic signaling system 100. The geographical information 212 may include any geographical description of the locality around the traffic signaling system 100, such as street maps, speed limits, or any other form of information useful in selecting among various routes using criteria specified by the route calculator 214. The route calculator 214 applies suitable selection and/or optimization routines to select a route using traffic flow information from the traffic signaling system 100, position information from the positioning system 208, and geographical information 212. Selection and/or optimization criteria may include such considerations as determining the shortest route, the quickest route, the route with the fewest traffic restrictors, and the like. The route calculator 214 may also take into account whether the status of traffic control devices 106 can be changed, such as, for example, by sending a wireless command signal to the traffic control device 106.

In operation, the wireless receiver 200 receives information from the traffic signaling system 100 in the form of a wireless signal. The wireless interface 204 extracts the information from the wireless signal, and the processor 202 decrypts the information using the encryption algorithm 210. Using geographical information 212 and position information from the positioning system 208, the processor 202 determines at least a portion of a route by applying the route calculator 214, suitably modifying the route based on traffic flow information. If the processor 202 determines that the status of a traffic control device 106 needs to be changed, the processor 202 sends a command to the traffic control device 106 using the wireless interface. In certain implementations, the process of calculating the route can be performed periodically or continuously based on updated traffic flow information, so that a vehicle can be rerouted in real time in response to new conditions, such as changes in the status of a traffic restrictor, decreased vehicle speed, or other factors affecting the route calculations.

Various other implementations of the wireless receiver 200 are also possible. For example, the changes of status for traffic control devices 106 may be controlled by the central station 102. In such implementations, wireless receiver 200 may communicate a request for a status change. The central station 102 may elect to change the status of the traffic control device 106 and confirm that the status has been changed in a response to the wireless device 200. Alternatively, the central station 102 may deny the request and instruct the wireless device 200 to determine an alternate route. In another example, the route calculations can be performed at a central station 102, and in such implementations, the route calculator 210 and some or all of the geographical information 208 may be maintained at the central station 102 rather than at the wireless receiver 200. It should be understood that such implementations can be used in the traffic signaling system 100 and the wireless receiver 200.

Figure 3:
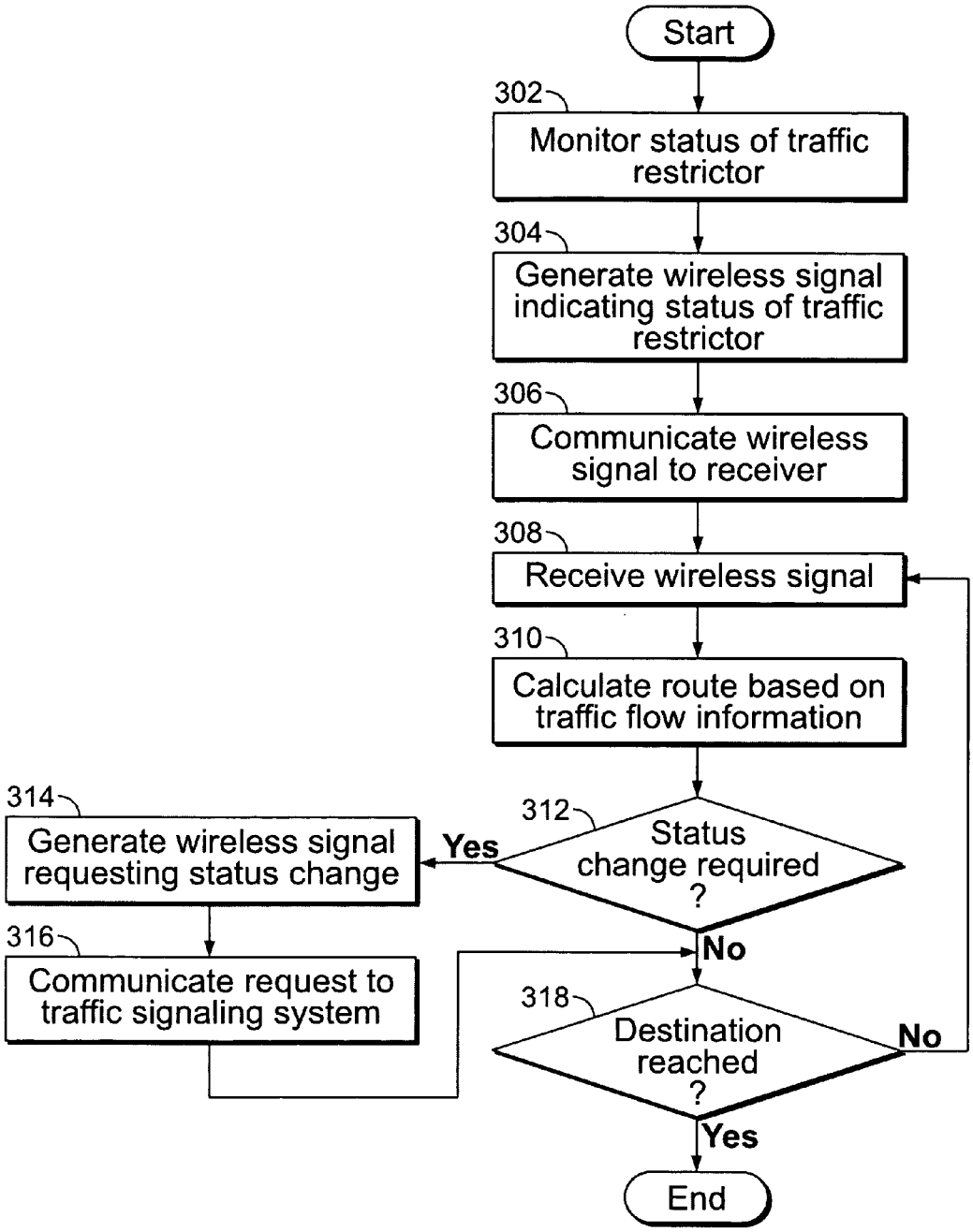
FIG. 3 is a flowchart illustrating a process for signaling traffic flow information and determining a route using the traffic flow information.

FIG. 3 is a flowchart 300 illustrating a process for signaling traffic flow information and determining a route using the traffic flow information. In particular, steps 302-306 relate to signaling traffic flow information. In certain implementations, signaling stations 104 perform these steps as part of the traffic signaling system 100. The status of their respective traffic restrictors is monitored at step 302. A wireless signal indicative of the status is generated at step 304, and the wireless signal is communicated to a receiver at step 306. In particular implementations, the receiver may be the central station 102, which relays the status information to vehicles, or the receiver may be a wireless receiver 200 associated with a vehicle. Steps 302-306 may be performed continuously and repeatedly, providing a constant source of status information on traffic restrictors.

Steps 308-318 describe a receiver receiving the wireless signal and determining a route using the traffic flow information provided in the wireless signal. In particular implementations, the receiver may be the wireless receiver 200 described above. In various implementations, the receiver may receive the wireless signal directly from the signaling station 104 and/or indirectly via the central station 102. The receiver performs the steps of the method as follows. The receiver receives the wireless signal at step 308. Using the traffic flow information received in the wireless signal, the receiver calculates at least a portion of a route at step 310 based on the traffic flow information, along with suitable geographical information 208 and/or position information about the vehicle being routed. If the calculated route involves changing the status of a traffic flow device 106, as shown by decision step 312, then the receiver generates a wireless signal requesting a status change at step 314. The receiver then communicates the signal to the traffic signaling system 100 at step 316. If no status change is required, then no such signal needs to be sent. Once the route is calculated and all appropriate requests for status change have been sent, the receiver may repeat the process from step 308 until the destination 118 is reached by the vehicle, as shown at decision step 318.

Obviously, the process described here is merely one example of numerous possible methods for signaling traffic flow information and/or determining a route based on the traffic flow information. Accordingly, many of the steps in this flowchart may take place simultaneously and/or in different orders than as shown. Moreover, processes with additional steps, fewer steps, and/or different steps, so long as the processes are consistent with any of the techniques described or suggested herein. In particular, any method of operation suitable for use with any of the implementations of the traffic signaling system 100 described above may be employed. In one example, the described method may be adapted for use in a decentralized traffic signaling system allowing vehicles to exchange information directly with signaling stations. In another example, particular functions may be performed by a central station 102, so that, for example, the route calculations may be performed at the central station 102 and communicated to the vehicles.

The described techniques can be implemented in digital electronic circuitry, integrated circuitry, or in computer hardware, firmware, software, or in combinations thereof. Apparatus for carrying out the techniques can be implemented in a software product (e.g., a computer program product) tangibly embodied in a machine-readable storage device for execution by a programmable processor; and processing operations can be performed by a programmable processor executing a program of instructions to perform the described functions by operating on input data and generating output. The techniques can be implemented advantageously in one or more software programs that are executable on a programmable system including at least one programmable processor coupled to receive data and instructions from, and to transmit data and instructions to, a data storage system, at least one input device, and at least one output device. Each software program can be implemented in a high-level procedural or object-oriented programming language, or in assembly or machine language if desired; and in any case, the language can be a compiled or interpreted language.

Suitable processors include, by way of example, both general and special purpose microprocessors. Generally, a processor will receive instructions and data from a read-only memory, a random access memory and/or a machine-readable signal (e.g., a digital signal received through a network connection). Generally, a computer will include one or more mass storage devices for storing data files; such devices include magnetic disks, such as internal hard disks and removable disks, magneto-optical disks, and optical disks. Storage devices suitable for tangibly embodying software program instructions and data include all forms of non-volatile memory, including by way of example semiconductor memory devices, such as EPROM (electrically programmable read-only memory), EEPROM (electrically erasable programmable read-only memory), and flash memory devices; magnetic disks such as internal hard disks and removable disks; magneto-optical disks; and CD-ROM disks. Any of the foregoing can be supplemented by, or incorporated in, ASICs (application-specific integrated circuits).

To provide for interaction with a user, the techniques can be implemented on a computer system having a display device such as a monitor or LCD (liquid crystal display) screen for displaying information to the user and a keyboard and a pointing device such as a mouse or a trackball by which the user can provide input to the computer system or a system which enables input and presents information via voice, symbols, or other means such as a Braille input and output system. The computer system can be programmed to provide a graphical user interface through which computer programs interact with users. With new technologies such as voice input and output, it is not a requirement to have a visual display to implement the described techniques.

Although this disclosure has been described in terms of certain embodiments and generally associated methods, alterations and permutations of these embodiments and methods will be apparent to those skilled in the art. For example, various functions of the traffic signaling system 100 may be consolidated within the described components or additional components, such as central station 102, or such functions may be distributed differently among described components or additional components. Accordingly, the above description of example embodiments does not define or constrain this disclosure. Other changes, substitutions, and alterations are also possible without departing from the spirit and scope of this disclosure.

What is claimed is:

1. A method comprising:

identifying a destination for a first vehicle;

determining a status of at least one traffic restrictor, the at least one traffic restrictor comprising at least one of a controllable traffic control device or an uncontrollable condition;

determining an availability status of the first vehicle based on the status of the at least one traffic restrictor;

selecting an alternate vehicle if the first vehicle is unavailable;

determining at least part of a route of the first vehicle or the alternate vehicle to the destination based on the status of the at least one traffic restrictor;

determining whether a status change for one or more controllable traffic control devices is required for the route; and initiating a change to the one or more controllable traffic control devices if the change in status of the one or more controllable traffic control devices is required.

2. The method of claim 1, wherein determining the availability status of the first vehicle based on the status of the at least one traffic restrictor comprises determining an estimated time to arrival to the destination based on the status of the at least one traffic restrictor.

3. The method of claim 1, wherein the controllable traffic control device comprises a traffic light and wherein determining the status of at the least one traffic restrictor comprises determining a light color of the traffic light for traffic associated with a particular direction of travel.

4. The method of claim 1, wherein the uncontrollable condition comprises one of a weather condition or traffic hazard and wherein determining a status of at least one traffic restrictor comprises determining a presence of a weather condition or a traffic hazard.

5. The method of claim 1, wherein selecting the alternate vehicle if the first vehicle is unavailable comprises determining a status of the at least one traffic restrictor along the route of the alternate vehicle.

6. The method of claim 1 further comprising determining an alternate route for the first or alternate vehicle based on the status of at least one traffic restrictor.

7. The method of claim 1 further comprising determining a speed and heading for the first or alternate vehicle, wherein at least the portion of the route is determined based on the speed and the heading of the first or alternate vehicle.

8. The method of claim 1, wherein determining a status of at least one traffic restrictor comprises receiving a wireless signal indicative of the status of the at least one traffic restrictor.

9. The method of claim 1, wherein initiating a change to the one or more controllable traffic control devices if the change in status of the one or more controllable traffic control devices is required comprises communicating a wireless request to change the status of the one or more controllable traffic control devices.

10. An article of manufacture comprising machine-readable storage device storing instructions for causing one or more data-processing apparatus, alone or in combination, to:

identify a destination for a first vehicle;

determine a status of at least one traffic restrictor, the at least one traffic restrictor comprising at least one of a controllable traffic control device or an uncontrollable condition;

determine at least part of a route to the destination for the first vehicle based on the status of the at least one traffic restrictor;

determine an availability status of the first vehicle based on the status of the at least one traffic restrictor;

select an alternate vehicle if the first vehicle is unavailable;

determine whether a status change for one or more controllable traffic control devices is required for the route; and initiate a change to the one or more controllable traffic control devices if the change in status of the one or more controllable traffic control devices is required.

11. The article of manufacture of claim 10, wherein the instructions for causing the one or more data-processing apparatus to determine the availability status of the first vehicle based on the status of the at least one traffic restrictor comprise instructions for causing the data-processing apparatus to determine an estimated time to arrival to the destination based on the status of the at least one traffic restrictor.

12. The article of manufacture of claim 10, wherein the controllable traffic control device is a traffic light, wherein instructions for causing the one or more data-processing apparatus to determine a status of at least one traffic restrictor comprise instructions for causing the one or more data-processing apparatus to determine a status of the traffic light, and wherein the status of the traffic light comprises a light color for traffic associated with a particular direction of travel.

13. The article of manufacture of claim 10, wherein the uncontrollable condition comprises one of a weather condition or traffic hazard and wherein instructions for causing the one or more data-processing apparatus to determine a status of at least one traffic restrictor comprise instructions for determining a presence of a weather condition or a traffic hazard.

14. The article of manufacture of claim 10, wherein instructions for causing the one or more data-processing apparatus to select the alternate vehicle if the first vehicle is unavailable comprises instructions for causing the one or more data-processing apparatus to:

determine at least a portion of a route of the alternate vehicle to the destination; and determine a status of the at least one traffic restrictor along the route of the alternate vehicle.

15. The article of manufacture of claim 10 further comprising instructions for determining an alternate route based on the status of at least one traffic restrictor.

16. The article of manufacture of claim 10 further comprising instructions for causing the one or more data-processing apparatus to determine a speed and heading for the first or alternate vehicle, wherein at least the portion of the route is determined based on the speed and the heading of the first or alternate vehicle.

17. The article of manufacture of claim 10, wherein the instructions for causing the one or more data-processing apparatus to determine a status of at least one traffic restrictor comprise instructions for causing the one or more data-processing apparatus to receive a wireless signal indicative of the status of the at least one traffic restrictor.

18. The article of manufacture of claim 10, wherein the instructions for causing the one or more data-processing apparatus to initiate a change to the one or more controllable traffic control devices if the change in status of the one or more controllable traffic control devices is required comprise instructions for causing the one or more data-processing apparatus to communicate a wireless request to change the status of the one or more controllable traffic control devices.

19. A traffic signaling system comprising:

at least one traffic restrictor, the at least one traffic restrictor comprising at least one of a controllable traffic control device or a device operable to identify an uncontrollable condition;

a first mobile unit; and one or more processing units communicably coupled to the at least one traffic restrictor and the mobile unit, the one or more processing units, alone or in combination, operable to:

identify a destination;

receive a signal indicative of a status of the at least one traffic restrictor;

determine an availability status of the first mobile unit based on the status of the at least one traffic restrictor;

select an alternate mobile unit if the first mobile unit is unavailable;

determine at least part of a route of the first or alternate mobile unit to the destination based on the status of the at least one traffic restrictor;

determine whether a status change for one or more controllable traffic control devices is required for the route; and initiate a change to the one or more controllable traffic control devices if the change in status of the one or more controllable traffic control devices is required.

20. The traffic signaling system of claim 19, wherein the one or more processing units are operable to determine the availability status of the first mobile unit based on the status of the at least one traffic restrictor by determining an estimated time to arrival to the destination based on the status of the at least one traffic restrictor.

21. The traffic signaling system of claim 19, wherein the controllable traffic control device comprises a traffic light, wherein the one or more processing units are operable to determine a status of the at least one traffic restrictor by determining a light color of the traffic light for traffic associated with a particular direction of travel.

22. The traffic signaling system of claim 19, wherein the device operable to identify an uncontrollable condition is operable to identify one of a weather condition or traffic hazard and wherein the one or more processing units are operable to determine a status of at least one traffic restrictor by determining a presence of a weather condition or a traffic hazard.

23. The traffic signaling system of claim 19, wherein the one or more processing units are operable to select the alternate mobile unit if the first mobile unit is unavailable by:

determining at least a portion of a route of the alternate mobile unit to the destination; and determining a status of the at least one traffic restrictor along the route of the alternate mobile unit.

24. The traffic signaling system of claim 19, wherein the one or more processing units are further operable to determine an alternate route based on the status of at least one traffic restrictor.

25. The traffic signaling system of claim 19, wherein the one or more processing units are further operable to determine a speed and heading for the first or alternate mobile unit, wherein at least the portion of the route is determined based on the speed and the heading of the first or alternate mobile unit.

26. The traffic signaling system of claim 19, wherein the one or more processing units are operable to determine the status of the at least one traffic restrictor by receiving a wireless signal indicative of the status of the at least one traffic restrictor.

27. The traffic signaling system of claim 19, wherein the one or more processing units are operable to initiate the change to the one or more controllable traffic control devices if the change in status of the one or more controllable traffic control devices is required by communicating a wireless request to change the status of the one or more controllable traffic control devices.

* * * * *